US005589447A

United States Patent [19]

Palicka

[11] Patent Number: 5,589,447

[45] Date of Patent: Dec. 31, 1996

[54] LIQUID DISHWASHING-DETERGENT COMPOSITION

[75] Inventor: Jadwiga Palicka, Lidingö, Sweden

[73] Assignee: Berol Nobel AB, Stenungsund, Sweden

[21] Appl. No.: 433,436

[22] PCT Filed: Nov. 3, 1993

[86] PCT No.: PCT/EP93/03092

§ 371 Date: May 10, 1995

§ 102(e) Date: May 10, 1995

[87] PCT Pub. No.: WO94/11476

PCT Pub. Date: May 26, 1994

[30] Foreign Application Priority Data

Nov. 11, 1992 [SE] Sweden ..... 9203373

[51] Int. Cl.[6] ..... C11D 1/12; C11D 1/72; C11D 1/90; C11D 1/94

[52] U.S. Cl. ..... 510/237; 510/423; 510/424; 510/537

[58] Field of Search ..... 252/546, 547, 252/174.21, 550, DIG. 7

[56] References Cited

U.S. PATENT DOCUMENTS 5,340,502 8/1994 Palicka ..... 252/546

FOREIGN PATENT DOCUMENTS 2165855 4/1986 United Kingdom .
9205236 4/1992 WIPO .

OTHER PUBLICATIONS

J. Palicka "2nd World Surfactants Congress 1988, Proceedings", May 1988, vol. III, pp. 449–475.
J, Palicka "3rd CESIO International Surfactant Congress 1992, Proceedings", Jun. 1992, CESIO, Sec D, pp. 300–318.

*Primary Examiner*—Erin M. Harriman

[57] ABSTRACT

A liquid dishwashing-detergent composition containing an anionic surfactant, at least two types of amphoteric compounds, and a nonionic surface active compound. The amphoteric compounds are characterized by general formula (I) and (III) or (IV):

$$\underset{B}{R-(A)_n-[N-(CHR_1)_x]_y-N}-\underset{B}{Q} \quad (I)$$

wherein R is a hydrocarbon group having 7–22 carbon atoms, n is 0 or 1, A is a carbonyl group (C(O)), a group $(OCH_2CH_2)_z$ or a group $(OCH_2CH_2CH_2)_z$ in which z is an integer from 1 to 5, $R_1$ is hydrogen or a lower alkyl group, x is 2 or 3, y is an integer from 0 to 4, Q is the group $—R_2COOM$ in which $R_2$ is an alkylene group having 1–6 carbon atoms and M is hydrogen or an ion from the groups alkali metals, alkaline earth metals, ammonium and substituted ammonium, and B is hydrogen or a group Q as defined above;

$$R-\overset{\overset{R'}{|}}{\underset{\underset{R'}{|}}{N^+}}-(CH_2)_n-COOM \quad (III)$$

$$R-\overset{\overset{O}{||}}{C}-NH-(CH_2)_3-\overset{\overset{R'}{|}}{\underset{\underset{R'}{|}}{N^+}}-(CH_2)_n-COOM \quad (IV)$$

wherein R is a longer hydrophobic hydrocarbon group having at least 7 carbon atoms, R' is an alkyl or hydroxyalkyl group having 1–4 carbon atoms, n is 1 or 2, and M is hydrogen or a sodium ion. The nonionic surface-active compounds consist of ethoxylated and/or propoxylated fatty alcohols.

7 Claims, No Drawings

LIQUID DISHWASHING-DETERGENT COMPOSITION

The preset invention is directed to liquid dishwashing-detergent compositions, more particularly compositions containing an anionic surfactant and a combination of amphoteric surface-active compounds and a non-ionic surfactant.

The liquid dishwashing detergents most common on the market today are primarily intended for washing by hand and as a rule consist of aqueous solutions containing anionic surfactants, such as alkyl sulphonates, alkylbenzene sulphonates, alkyl sulphates and alkyl ether sulphates, as an essential ingredient.

Thus the article J Palicka 2nd World Surfactants Congress 1988, May 1988, CESIO and ASPA, Paris, Volume III on page 474, table 8 and WO 92/05236, in the Example disclose a dishwashing composition comprising a combination of two amphoteric compounds, an anionic surfactant and as a foam stabiliser and foam booster and a cocodiethanol amide or an amine oxide. Further in the article J Palicka, 3rd CESIO International Surfactant Congress and Exhibition, June 1992 CESIO, London, section D, page 311, a dishwashing composition is disclosed containing a combination of three amphoteric and zwitterionic compounds and an anionic surfactant.

Amine oxides or alkyl diethanolamides are generally used as foam stabilisers. Both compounds give a high and lasting foam, but are disadvantageous in terms of toxicity, involving the risk of nitroseamine formation at an unacceptable level. Thus, there is a need for a dishwashing detergent having a good cleaning capacity and good foam formation without involving any risk of nitroseamine formation.

According to the present invention, it has been found that dishwashing detergents of good cleaning capacity and excellent foam formation can be obtained by using a combination of different types of amphoteric surface-active compounds and certain non-ionic surface-active compounds in dishwashing detergents based on anionic surfactants. The inventive dishwashing-detergent compositions are especially suitable, by their milldness, for washing by hand e.g. glass, china, and kitchen utensils. The inventive dishwashing-detergent compositions not only have the advantage of showing good foaming properties, i.e. high and lasting foam, but also are advantageous in that they can be produced in high-concentration form and are very kind to the skin.

Thus, the present invention relates to a dishwashing-detergent composition as defined in the appended claims.

In the dishwashing-detergent compositions according to the invention, use is made of a combination of at least two, preferably three, types of amphoteric compounds, hereinafter referred to as type a), type b) and type c). The amphoteric surface-active compounds of type a) are characterised by the general formula (I)

$$R-(A)_n-[\underset{\underset{B}{|}}{N}-(CHR_1)_x]_y-\underset{\underset{B}{|}}{N}-Q \qquad (I)$$

wherein R is a hydrocarbon group having 7–22 carbon atoms, n is 0 or 1, A is a carbonyl group [C(O)], a group $(OCH_2CH_2)_z$ or a group $(OCH_2CH_2CH_2)_z$ in which z is an integer from 1 to 5, $R_1$ is hydrogen or a lower alkyl group, x is 2 or 3, y is an integer from 0 to 4, Q is the group —$R_2$COOM in which $R_2$ is an alkylene group having 1–6 carbon atoms and M is hydrogen or an ion from the groups alkali metals, alkaline-earth metals, ammonium and substituted ammonium, and B is hydrogen or a group Q as defined above.

Amphoteric compounds of this type are previously known and are used in cleaning and shampoo compositions. Such compounds are described e.g. in EP Patent Applications 160 507, 162 600 and 214 868.

In the amphoteric surface-active compounds of type a) utilised in the inventive dishwashing-detergent compositions, R is a hydrocarbon group having 7–22 carbon atoms, suitably 11–22 carbon atoms.. The hydrocarbon group R can be straight or branched, saturated or unsaturated and may optionally contains substituents, such as hydroxyl groups. The group R may also be a cycloalkyl-alkyl group, an aralalkyl group or an aralkenyl group in which the alkyl or alkenyl group contains at least 6 carbon atoms. Preferably, R is an alkyl or alkenyl group, and it is especially preferred for R to be a hydrocarbon group originating from coco fatty acid, tallow fatty acid or oleinic acid. As indicated above, the amphoteric compounds may contain a group A consisting of a carbonyl Group or one or more ethoxy or propoxy groups. When A consists of ethoxy or propoxy groups, ethoxy groups are preferred, and A then preferably is such a group. Compounds that do not contain a group A, i.e. in which n is 0, or contain a group A consisting of a carbonyl group, are preferred, and compounds containing a carbonyl group are especially preferred. In the given formula, $R_1$ is hydrogen or a lower alkyl group, suitably having 1–6 carbon atoms, and preferably is hydrogen or a methyl group. Further, x is 2 or 3, and y suitably is 2, 3 or 4, preferably 2 or 3. Conveniently, the group $R_2$ is a methylene or ethylene group, preferably a methylene group. M is hydrogen or an ion from the groups alkali metals, alkaline-earth metals, ammonium and substituted ammonium, such as mono-, di- and trihydroxyethyl ammonium. Preferably, M is a sodium ion.

$$R-(A)_n-[\underset{\underset{B}{|}}{N}-(CH_2)_x]_y-\underset{\underset{B}{|}}{N}-Q \qquad (II)$$

wherein n is 0 or 1, and, when n is 1, A is a carbonyl group, Q is $CH_2$—COOM or $CH_2CH_2$—COOM, y is 1, 2 or 3, and wherein M, R, x and B are as indicated above. Suitably, x is 3 and all the Groups B are Q groups.

Mixtures of amphoteric compounds having different y values are especially preferred. In these compounds, R conveniently originates from tallow fatty acid, coco fatty acid, or oleinic acid.

Amphoteric compounds of type b) consist of betaines or amido betaines, which can be characterised by the general formulae (III) and (IV):

$$R-\overset{\overset{R'}{|}}{\underset{\underset{R'}{|}}{N^+}}-(CH_2)_nCOOM \qquad (III)$$

$$R-\overset{\overset{O}{||}}{C}-NH-(CH_2)_3-\overset{\overset{R'}{|}}{\underset{\underset{R'}{|}}{N^+}}-(CH_2)_nCOOM \qquad (IV)$$

wherein R is a longer hydrophobic hydrocarbon group, which suitably consists of a saturated or unsaturated, straight or branched aliphatic hydrocarbon Group having at least 7 carbon atoms. Conveniently, R has 7–21 carbon atoms and preferably is an alkyl or alkenyl group having 11–17 carbon atoms. R' is an alkyl or hydroxyalkyl Group having 1–4 carbon atoms. It is the most convenient that the two R' groups are methyl groups, n being 1 or 2. Preferably, M is hydrogen or a sodium ion.

Amphoteric compounds of type c) can be characterised by the General formula (V)

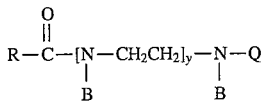

(V)

wherein R, y, Q and B are as indicated for compounds of formula (I). However, one group B is the group —$CH_2CHR'OH$, in which R' is H or $CH_3$. Suitable and preferred definitions of R and M in the group Q are as indicated for compounds of formula (I). It is the most convenient to use compounds of formula (V) in which y is 1 and Q is the group —$CH_2COOM$. Typical examples are compounds of formula (Va) and/or formula (Vb)

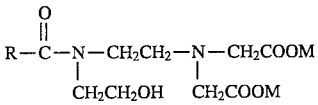

(Va)

and/or

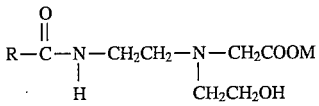

(Vb)

Amphoteric compounds of formulae (Va) and (Vb) are commercially available in the form of mixtures, usually having a weight ratio of compounds of formula (Va) to compounds of formula (Vb) in the range of 1:10–10:1.

The inventive dishwashing detergent contains amphoteric compounds of at least type a) and type b). Preferably, the combination of amphoteric compounds used includes amphoteric compounds of type a), type b) as well as type c). Preferably, the amphoteric compounds of type b) in the dishwashing detergent consist of betaines, i.e. compounds of formula (III). In the dishwashing detergent, the amphoteric compounds of type a) primarily have a favourable effect on the foam height, while the amphoteric compounds of type b) have a favourable effect on the durability of the foam. The amphoteric compounds of type c) act as solutisers, promote the mixing process and contribute to giving the detergents the right viscosity, also at high concentrations.

The inventive dishwashing detergent also contains certain non-ionic compounds as an essential ingredient. These compounds consist of ethoxylated and/or propoxylated adducts of fatty alcohols, preferably having 9–16 carbon atoms. Conveniently, the alcohols contain 4–20 ethylene oxide groups and/or propylene oxide groups, preferably 4–14 such groups. These non-ionic surface-active compounds primarily serve as foam stabilisers.

According to the invention, it has been found that amphoteric compounds combined as above and non-ionic ethoxylated and/or propoxylated fatty alcohols give uncommonly satisfactory foaming properties as well as a good cleaning capacity in dishwashing detergents based on anionic surfactants. The inventive dishwashing detergents containing the above ingredients can be produced with high contents of active substance, up to 50% by weight, and still result in clear low-viscosity solutions, even at such high concentrations. The dishwashing detergents are very advantageous in terms of toxicity, since all the amphoteric compounds included have been found to give as low contents as 2–4 ppb in nitroseamine tests.

Even though inventive dishwashing detergents containing a combination of amphoteric compounds of type a) and type b) have good foaming properties and a good cleaning effect, it is preferred that the detergents contain amphoteric compounds of type a), type b) as well as type c), which facilitates their preparation. Especially, it becomes easier to achieve the right viscosity, in particular at high contents of active substance.

In the inventive dishwashing-detergent compositions, the weight ratio of the non-ionic compounds to the total amount of amphoteric compounds suitably is at least 1:1. Conveniently, this ratio is in the range of 1:1–2:1, preferably in the range of 1:1–1.5:1. The combination of amphoteric surface-active compounds conveniently has an excess of at least 15% by Weight of compounds of type a) in relation to, respectively, amphoteric compounds of type b) and compounds of each of type b) and type c), when both are present. Conveniently, the excess is in the range of 15–90% by weight. The total amount of surface-active amphoteric compounds and non-ionic compounds in the dishwashing detergents suitably is at least 20% by weight of the anionic surfactants, preferably 30–70% by weight thereof. The total content of amphoteric compounds and non-ionic compounds as well as the anionic surfactants in the dishwashing detergents may be 10–50% by weight and, in the case of high-concentration dishwashing detergents, usually is 35–50% by weight.

As is conventional, the anionic surfactants in the dishwashing detergents consist of water-soluble sulphates or sulphonates, especially alkyl sulphates, alkyl ether sulphates, alkyl sulphonates and alkyl aryl sulphonates, in which the alkyl group usually contains 8–22 carbon atoms. For the anionic surfactants containing ether groups, these usually are ethylene oxide groups, and the compounds normally contain 1–10 such groups per molecule.

Usually, the cations are of alkali metals, alkaline-earth metals, ammonium or amines, such as mono-, di- and triethanolamine cations. Specific examples of anionic surfactants are sodium lauryl sulphonate, sodium lauryl ether sulphate having two or three ethylene oxide groups, corresponding ammonium or ethanolamine salts, sodium or other salts of dodecylbenzene sulphonic acid and alkylbenzene sulphonic acid, in which the alkyl group contains 11–13 carbon atoms on average. often, at least two different anionic surfactants are used in dishwashing detergents.

The inventive dishwashing-detergent compositions are liquid. Naturally, the main ingredient preferably is water. Often, liquid dishwashing-detergent compositions contain deionised water, but other types of water may also be used. Also other liquid solvents can be included, such as lower alcohols, glycols and lower alkyl ethers of glycols. These types of solvents are normally included in minor amounts, if at all present. Specific examples are ethanol, ethylene glycol and monopropylene glycol. Sometimes, solvents are mainly included as a preservative constituent. The inventive compositions, however, have the advantage of not requiring any preservative.

The inventive dishwashing-detergent compositions can be prepared in conventional manner by simply mixing the ingredients, and they may of course be used in conventional fashion. Normal dosage of a dishwashing-detergent composition having a total dry solids content of about 10–50% by weight is about 0.2 g/l of dishwater.

The main ingredients of the inventive dishwashing-detergent compositions have been accounted for in the foregoing. Naturally, also other conventional substances may be included in order to improve various properties, such as thickeners, colouring agents, pigments and perfumes. Other amphoteric compounds and non-ionic compounds may also be included, provided that they do not have any adverse effect on the essential cleaning and foaming properties.

The invention will now be illustrated by a non-restricting Example. The figures in parts and per cent are all by weight, unless otherwise stated.

EXAMPLE

The dishwashing-detergent compositions below all contained the following amounts of anionic surfactants and other additives:

Lauryl alcohol sulphate (28%): 35.7% by weight

Ammonium lauryl ether sulphate having 3 ethylene oxide groups (75%): 13.3% by weight Cumene sulphonate (40%): 5.0% by weight Urea: 2.0% by weight Citric acid: 0.3% by weight All figures given in per cent by weight are based on the total composition, containing water to 100% by weight.

Composition 1, According to the Invention

Amphoteric compounds: Type a)—Ampholak® 7CX (available from Berol Nobel AB, Sweden)—according to formula (II) containing a carbonyl group, R being a residue of coco fatty acid. The compound (30%) was present in an amount of 12.5% by weight. Type b) alkyl dimethyl betaine in which the alkyl chain mainly consisted of C12–C14 groups. The compound (30%) was present in an amount of 10.5% by weight.

Non-ionic compounds: Ethoxylated C9–C11 alcohol having 8 ethylene oxide groups and being present in an amount of 8.0% by weight.

Composition 2, According to the Invention

Amphoteric compounds: Type a)—Ampholak® 7CX (available from Berol Nobel AB, Sweden)—according to formula (II) containing a carbonyl group, R being a residue of coco fatty acid. The compound (30%) was present in an amount of 10.0% by weight. Type b) alkyl dimethyl betaine in which the alkyl chain mainly consisted of C12–C14 groups. The compound (30%) was present in an amount of 8.0% by weight. Type c)—Ampholak® XCO-30 (available from Berol Nobel AB, Sweden)—a mixture of compounds according to formulae (Va) and (Vb), R being a residue of coco fatty acid. The compounds (30%) were present in an amount of 5% by weight.

Non-ionic compounds: Ethoxylated C9–C11 alcohol having 8 ethylene oxide groups and being present in an amount of 4.0% by weight, as well as ethoxylated and propoxylated C10–C12 alcohol having 7 ethylene oxide groups and 1 propylene oxide group and being present in an amount of 4% by weight.

Composition 3, According to the Invention

Amphoteric compounds: the same as in composition 1 and present in the same amounts.

Non-ionic compounds: Ethoxylated C9–C11 alcohol having 8 ethylene oxide groups and being present in an amount of 8% by weight.

Composition 4, Included for Comparative Purposes

Amphoteric compounds: only amphoteric compound of type a), which was the same as in composition 1 and was present in an amount of 23.0% by weight.

Non-ionic compounds: Ethoxylated C9–C11 alcohol having 8 ethylene oxide groups and being present in an amount of 8% by weight.

Composition 5, Included for Comparative Purposes

Amphoteric compounds: only amphoteric compound of type b), which was the same as in composition 2 and was present in an amount of 23.0% by weight.

Non-ionic compounds: Ethoxylated C9–C11 alcohol having 8 ethylene oxide groups and being. present in an amount of 8% by weight.

Composition 6, Included for Comparative Purposes

Amphoteric compounds: only amphoteric compound of type c), which was the same as in composition 2 and was present in an amount of 23.0% by weight.

The cleaning effect of the compositions was tested as follows. Standard plates having a diameter of 16.5 cm were coated with 1 $cm^3$ of tallow fat. The fat was spread on the plates with a brush, and the plates were left to dry overnight. Then, 0.2 g of the above dishwashing-detergent compositions was added to 8 l of water having a hardness of 20° dH, and the water was heated to 45° C. ±2° C. When this temperature had been attained, the water was agitated at a speed of 400 rpm for 1 min so as to produce foam. Thereafter, the plates were washed by hand one by one until all the foam was gone, and the washed plates were counted.

The foaming properties of the above compositions were determined by rotating 40 times cylinders filled with water and the above compositions in a concentration of 4 g/l of water, whereupon the foam height was read. This operation was repeated, and 2.5 ml of Béchamel sauce was added to the mixture of water and dishwashing detergent before each operation of rotation. The foam height was measured after each such operation, and these were continued until the foam had substantially disappeared, i.e. the foam was then on a level of about 55 ml.

The results of the cleaning and foaming tests are given in the Tables below.

TABLE 1

| Composition No. | Number of cleaned plates |
|---|---|
| 1, according to the invention | 23 |
| 2, according to the invention | 25 |
| 3, according to the invention | 25 |
| 4, included for comparative purposes | 9 |
| 5, included for comparative purposes | 25 |
| 6, included for comparative purposes | 22 |

TABLE 2

| Composition No. | Foam picture ml |
|---|---|
| 1, according to the invention | 350 |
| | 250 |
| | 180 |
| | 120 |
| | 80 |
| | 70 |
| | 65 |
| | 60 |
| 2, according to the invention | 300 |
| | 115 |
| | 100 |
| | 80 |
| | 65 |

TABLE 2-continued

| Composition No. | Foam picture ml |
|---|---|
| | 60 |
| | 55 |
| 3, according to the invention | 350 |
| | 285 |
| | 215 |
| | 145 |
| | 90 |
| | 75 |
| | 65 |
| | 60 |
| | 55 |
| 4, included for comparative purposes | 330 |
| | 120 |
| | 80 |
| | 60 |
| | 55 |
| 5, included for comparative purposes | 245 |
| | 185 |
| | 145 |
| | 125 |
| | 85 |
| | 70 |
| | 65 |
| | 60 |
| | 55 |
| 6, included for comparative purposes | 270 |
| | 150 |
| | 115 |
| | 85 |
| | 70 |
| | 60 |
| | 55 |

Thus, the inventive compositions had a good cleaning effect as well as excellent foaming properties, i.e. a high initial foam level and a lasting foam.

I claim:

1. An anionic surfactant-based liquid dishwashing-detergent composition, comprising a) at least one amphoteric surface-active compound of type a) having the general formula (I)

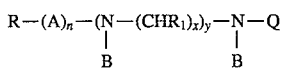

(I)

wherein R is a hydrocarbon group having 7–22 carbon atoms, n is 0 or 1, A is a carbonyl group (C(O)), a group $(OCH_2CH_2)_z$ or a group $(OCH_2CH_2CH_2)_z$ in which z is an integer from 1 to 5, $R_1$ is hydrogen or a lower alkyl group, x is 2 or 3, y is an integer from 0 to 4, Q is the group —$R_2$COOM in which $R_2$ is an alkylene group having 1–6 carbon atoms and M is hydrogen or an ion from the groups alkali metals, alkaline-earth metals, ammonium and substituted ammonium, and B is hydrogen or a group Q as defined above, b) at least one amphoteric surface-active compound of type b) having the general formula (III) or (IV)

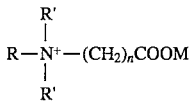

(III)

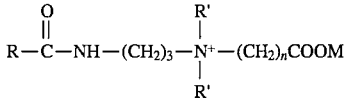

(IV)

wherein R is a longer hydrophobic hydrocarbon group having at least 7 carbon atoms, R' is an alkyl or hydroxyalkyl group having 1–4 carbon atoms, n is 1 or 2, and M is hydrogen or a sodium ion, c) at least one non-ionic surface-active compound consisting of an ethoxylated and/or propoxylated adduct of a fatty alcohol, and d) at least one anionic surfactant, wherein the total amount of amphoteric compounds of type a) and type b) and ethoxylated and/or propoxylated fatty alcohol is 20 to 70% by weight, based on the anionic surfactant, and the weight ratio of ethoxylated and/or propoxylated fatty alcohol to the total amount of amphoteric surface-active compounds is from 1:1–2:1.

2. The composition as claimed in claim 1, further comprising at least one amphoteric surface-active compound of type c) having the general formula (V)

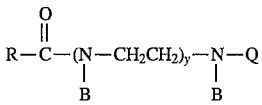

(V)

wherein R, y, Q and B are as indicated for compounds of formula (I), and at least one group B is —$CH_2$CHR'OH in which R' is H or $CH_3$ when y is an integer from 1 to 4.

3. The composition as claimed in claim 1, wherein the amphoteric compound of type a) has the general formula (II)

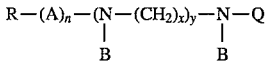

(II)

wherein n is 0 or 1, and, when n is 1, A is a carbonyl group, Q is $CH_2$—COOM or $CH_2CH_2$—COOM, y is 1, 2 or 3, and wherein M, R, x and B are as indicated in claim 1.

4. The composition as claimed in claim 1, wherein the amphoteric compound of type b) has the general formula

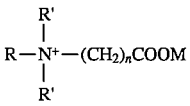

(III)

wherein R, R', n and M are as indicated in claim 1.

5. The composition as claimed in claim 2, wherein the amphoteric compound of type c) has formula (Va) and/or formula (Vb)

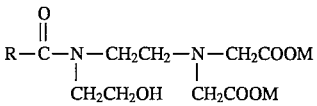

(Va)

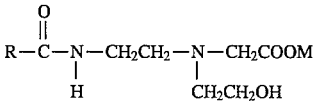

(Vb)

wherein R and M are as indicated in claim 2.

6. The composition as claimed in claim 1, wherein the non-ionic surface-active compound consists of an ethoxylated and/or propoxylated adduct of a fatty alcohol having 9–16 carbon atoms and containing 4–14 ethylene oxide groups and/or propylene oxide groups.

7. The composition as claimed in claim 1, 2, 3, 4, 5 or 6, wherein the amphoteric compounds of type a) are present in an excess of at least 15% by weight in relation to, respectively, amphoteric compounds of type b) and amphoteric compounds of each of type b) and type c).

* * * * *